United States Patent [19]

Picavet

[11] 4,373,879

[45] Feb. 15, 1983

[54] ALTERNATING ROTOR MOTOR WITH SPRING CLUTCHES

[76] Inventor: Rudolf P. Picavet, 2629 Jane St., Downsview, Ontario, Canada

[21] Appl. No.: 314,758

[22] Filed: Oct. 26, 1981

[51] Int. Cl.[3] ..... F01C 1/063; F02B 53/00

[52] U.S. Cl. ..... 418/35

[58] Field of Search ..... 418/33–35; 123/43 B, 245

[56] References Cited

U.S. PATENT DOCUMENTS

| | | | |
|---|---|---|---|
| 932,321 | 8/1909 | Plates | 418/35 |
| 3,186,383 | 6/1965 | Potter | 418/35 |
| 3,227,090 | 1/1966 | Bartolozzi | 418/35 |
| 3,282,258 | 11/1966 | Sinnott | 418/35 |
| 3,340,815 | 9/1967 | Sinnott | 418/35 |
| 4,279,577 | 7/1981 | Appleton | 418/35 |

FOREIGN PATENT DOCUMENTS

| | | | |
|---|---|---|---|
| 52-36204 | 3/1977 | Japan | 418/35 |

*Primary Examiner*—John J. Vrablik

[57] ABSTRACT

The present invention provides a rotary motor in which first and second coaxial opposing rotors mounted on independent rotor shafts are adapted to rotate within a housing. Each of the rotor shafts is provided with a fixed spring clutch and a free spring clutch in engagement with a torque receiving shaft common to both of the rotor shafts. According to the rotary motor, this torque receiving shaft is alternately driven by the two rotor shafts through the rotation of the opposing rotors.

9 Claims, 7 Drawing Figures

ALTERNATING ROTOR MOTOR WITH SPRING CLUTCHES

FIELD OF THE INVENTION

The present invention relates to a rotary motor arrangement including a pair of rotors which alternate with one another, such that while one of the rotors is rotating to produce portions of a combustion cycle, the other rotor remains stationary. Each of the rotors is mounted on its own rotor shaft adapted to drive a common torque receiving shaft.

BACKGROUND OF THE INVENTION

Rotary motors using a pair of rotors, which alternate with one another such that while one of the rotors is in operation the other rotor is stationary, are known in the prior art. An example of such a rotary motor, as shown in U.S. Pat. No. 932,321 to Plates Richards Rotary Engine Limited, was patented as early as Aug. 24, 1909. More recent examples of this type of rotary engine are shown in U.S. Pat. No. 3,340,815 issued Sept. 12, 1967 to E. L. Synot; U.S. Pat. No. 3,227,090 isued Jan. 4, 1966 to L. Bartelozi and U.S. Pat. No 4,279,577 issued July 21, 1981 to Appleton.

A feature, which is common to all of the above patented structures, is that both of the rotors are mounted on one rotor shaft thereby necessitating the need for complicated release and catch mechanisms to enable the alternate rotation of the two rotors relative to the single shaft.

In addition, none of the previously patented structures mentioned above are adapted for computer operation which, in accordance with the ever increasing costs of fuel, could provide extreme benefits by maximizing efficiency of operation of the rotary motor.

SUMMARY OF THE INVENTION

The present invention provides a rotary motor adapted to overcome drawbacks encountered with the prior art structure. The rotary motor of the present invention comprises a housing, first and second coaxial opposing rotors rotatable within the housing, first and second rotor shafts on which the first and second rotors are mounted respectively, a torque receiving shaft alternately driven by the first and second rotor shafts, a first fixed spring clutch wound on the first rotor shaft and arranged to bind on the first rotor shaft for substantially preventing rotation in a first direction while allowing rotation of the first rotor shaft in a second direction opposite to the first direction, a first movable spring clutch wound around and adapted to bind on and rotate with the first rotary shaft when rotating in the second direction, a second fixed spring clutch wound on the second rotor shaft and arranged to bind on the second rotor shaft for substantially preventing rotation in the first direction while allowing rotation of the second rotor shaft in the second direction, a second movable spring clutch wound around and adapted to bind on and rotate with the second rotor shaft when rotating in the second direction and drive means connecting the first and second movable spring clutches to the torque receiving shaft.

According to this arrangement, the first and second rotors are adapted to alternately, rotate in the second direction with the movable spring clutches providing in turn drive, through each rotor shaft when rotating, to the torque receiving shaft and providing slippage around each rotor shaft when each rotor shaft is prevented from rotating, thereby enabling the alternating rotation of the rotors.

Through the use of this relatively uncomplicated and inexpensive clutching mechanism, allowing only the desired rotation of the rotors both rotors are easily used to drive the torque receiving shaft which is common to the two rotors. Furthermore, the rotary motor of the present invention lends itself extremely well to use with computer operated controls requiring very few functions to maximize the efficiency of its operation.

BRIEF DESCRIPTION OF THE DRAWINGS

The above as well as further advantages and features of the present invention will be described in greater detail according to the preferred embodiments of the present invention in which.

DETAILED DESCRIPTION OF THE PREFERRED EMBODIMENTS

Figure 1:
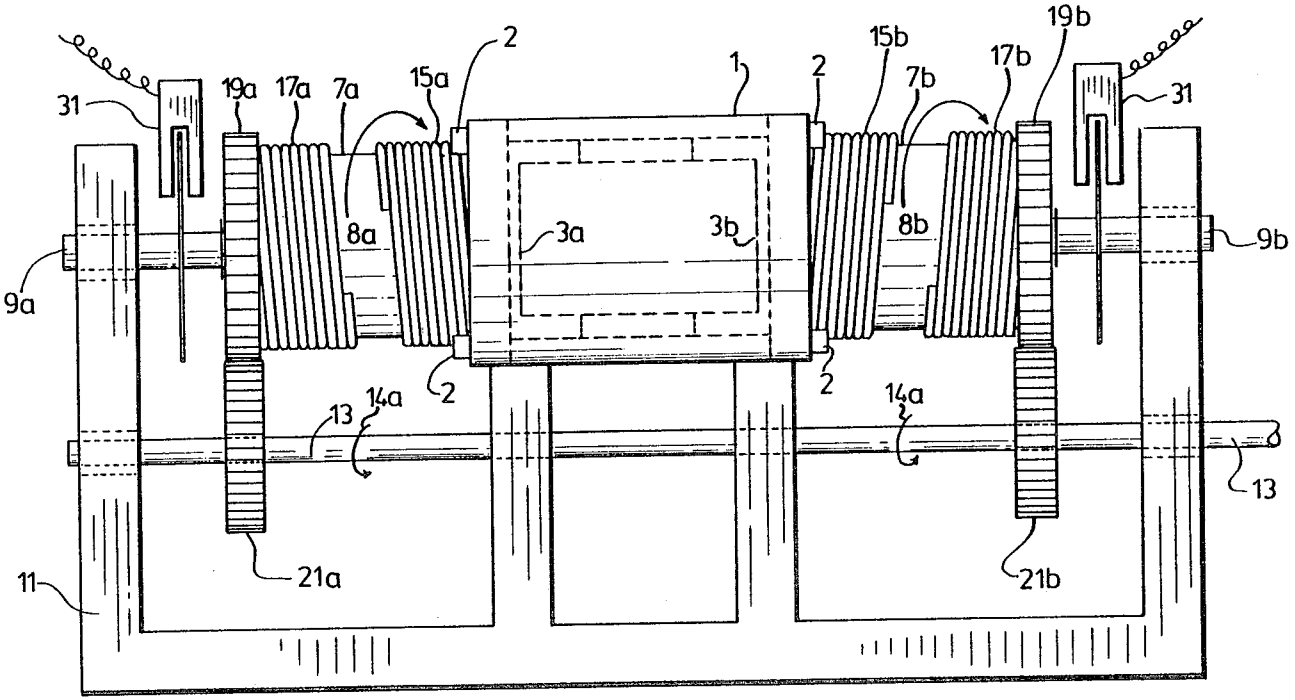
FIG. 1 is a plan view showing a rotary engine setup according to a preferred embodiment of the present invention.
Figure 2:
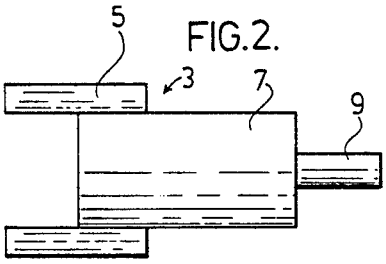
FIG. 2 is a side view of one of the rotors used in the motor of FIG. 1.

The rotary motor arrangement of FIG. 1 comprises a rotor housing 1 supported by a support base 11. A pair of rotors, as typically shown in FIG. 2 and indicated at 3, are rotatable within the housing. Each of these rotors includes a shaft 7 having a pair of rotor portions 5, as well as an axle portion 9 rotatably journaled within the support 11.

Also rotatably fitted within the base support is a torque pickup shaft 13 extending beneath both sides of the motor. This shaft is provided with a pair of gear wheels 21*a* and 21*b* rotationally coupled to the torque pickup shaft.

For purposes of maintaining the description as clear as possible, the visible parts of the rotor in FIG. 1 to the righthand side of the Figure have been designated by reference b while the rotor parts on the lefthand side of the Figure have been designated by reference a, even though the rotors are identical to one another.

Referring now to the lefthand side of FIG. 1, the rotor shaft 7*a* is fitted with spring clutches 15*a* and 17*a*. The inside spring clutch 15*a* is fixed in position by means of housing studs 2 and, therefore, binds on the rotor shaft 7*a* when the rotor shaft attempts to rotate in the direction in which the fixed spring clutch is wound relative to motor studs 2. This same fixed spring clutch will, on the other hand, allow rotation of rotor shaft 7*a* in the direction of arrow 8*a*, as shown in FIG. 1, because the windings on the spring tend to open and do not bind on the rotor shaft in this direction.

Movable spring clutch 17*a* is secured to gear wheel 19*a* on the outside end of the movable spring clutch, so that it winds inwardly from the gear wheel. Therefore, when rotor shaft 7*a* binds on and rotates with the rotor shaft. Gear 19*a* is carried with spring clutch 17*a* to drive torque shaft 13 through gear 21*a*.

With reference to the righthand side of the Figure, fixed spring clutch 15b is set up to allow rotation of rotor shaft 7b in the direction of arrow 8b, while substantially preventing its rotation in the opposite direction by binding on the rotor shaft. Again spring clutch 17b is adapted to bind on and rotate with the rotor shaft as it is rotated in the direction of arrow 8b. It should be noted that arrows 8a and 8b correspond to one another, such that shafts 7a and 7b are allowed to rotate in the same direction. However, rather than rotating simultaneously, they alternate with one another in rotation, as described below in greater detail.

FIGS. 3a through 3d show in section the inside of the rotor housing which includes an annular rotor chamber 23 having an inlet port 29 and an exhaust port 27. A firing mechanism 25, such as a spark plug or the like, is located at the periphery of the rotor chamber substantially across from the inlet port to the chamber. The timing for the firing of mechanism 25 is computer operated, so that it may be controlled for maximum efficiency.

In FIGS. 3a through 3d, the rotor portions for rotors 3a and 3b are shown in section. Rotor 3a, shown in dotted lines in FIG. 1, produces rotation of shaft 7a while rotor 3b produces rotation of shaft 7b. Throughout FIGS. 3a through 3d, the rotor portions for rotor 3a are shown at 5a and 5a', while the rotor portions for rotor 3b are shown at 5b and 5b'.

Figure 3A:
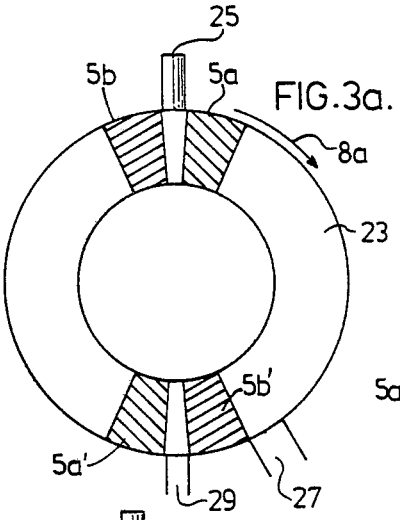
FIGS. 3*a* through 3*d* are sectional views through the housing of the rotary motor of FIG. 1, showing in sequence, operation of the rotors within the housing.

FIG. 3a shows the motor at the beginning of a first combustion cycle produces through rotor 3a. In this position, which may be meachanically controlled, the two rotors are separated by a small area at the firing mechanism and at the inlet port to chamber 23. When the two rotors are in this position, plug 25 is fired through the computer producing a force to rotate rotor 3a in the direction of arrow 8a. Rotor 3b and its respective rotor portions is, on the other hand, prevented from rotating in the opposite direction through spring clutch 15b, so that it remains stationary while rotor 3a is rotating. The stationary rotor 3b, therefore, acts as a backstop to the pressure produced at firing so that rotor 3a is driven forwardly.

Figure 3B:
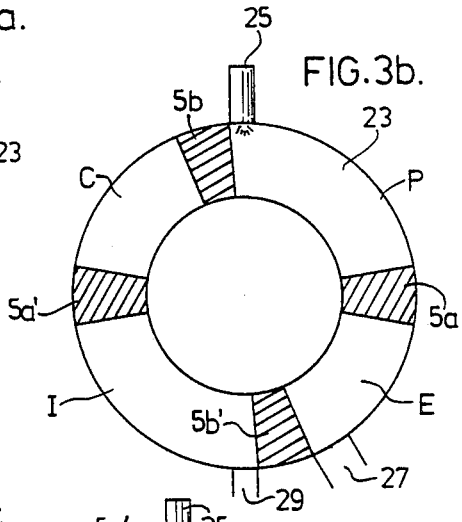

FIG. 3b shows rotor 3a, after having moved through about one quarter of its full combustion cycle. In this position the power portion of the cycle occurs in the annular chamber 23 between rotor portions 5a and 5b, as indicated at P. The exhaust portion of the cycle occurs between rotor portions 5a and 5b' as indicated at E. The intake portion of the cycle occurs between rotor portions 5b' and 5a' as indicated at I and the compression portion of the cycle occurs between rotor portions 5a' and 5b as indicated at C. It should be noted in FIG. 3b that rotor 3b and its rotor portions have not moved from the FIG. 3a position.

Figure 3C:
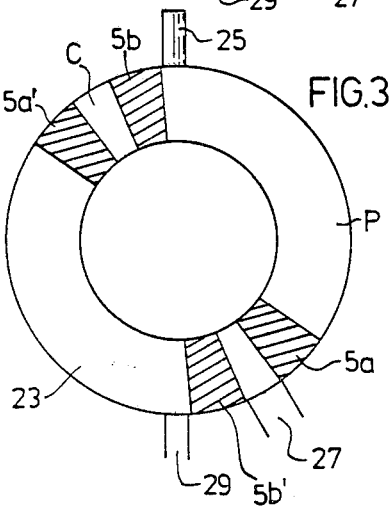
Figure 3D:
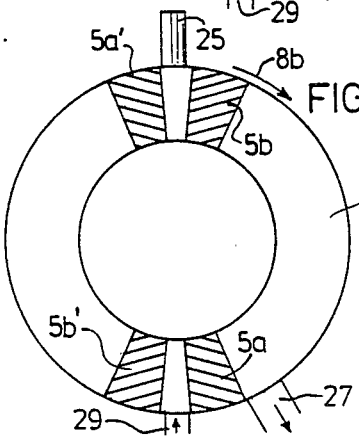

In FIG. 3c, the rotor 3a is just coming up to the end of its complete combustion cycle, where rotor portions 5a and 5a' are approaching rotor portions 5b' and 5b respectively on the still stationary rotor 3b. However at this point, the compression portion of the cycle is at a maximum whereas the power portion of the cycle is at a minimum, such that the rotor 3a in fact begins to provide a driving force on rotor 3b to push rotor 3b from behind and to move rotor 3b such that rotor portions 5b and 5b' assume the FIG. 3d position. At the same time, rotor 3a continues itself to rotate to the FIG. 3d position at which time plug 25 again fires causing a power portion of a new combustion cycle to be produced between rotor portions 5a' and 5b, such that the latter rotor portion is driven in the direction of arrow 8b, while at the same time producing a driving force against rotor portion 5a' in the opposite direction. However, rotor 3a and its rotor portions 5a' and 5a are prevented from reversing by means of spring clutch 15a, so that rotor 3a now becomes stationary, while rotor 3b moves through its combustion cycle.

As the two rotor shafts rotate in sequence with one another, there is alternating drive applied to torque receiving shaft 13 common to both of the rotors. However, it must be remembered that both of the gears 19a and 19b are always in geared contact with torque receiving gears 21a and 21b respectively. Therefore, there must be alternate slippage allowed at each of the gears 19a and 19b to enable a consistent rotation on torque receiving shaft 13. This slippage is provided through the provision of movable spring clutches 17a and 17b.

The slippage is best described by returning to FIG. 1. If for instance rotor shaft 7a is caused to rotate through its rotor 3a, the direction of rotation is as described above along arrow 8a. This produces a rotation on the torque receiving shaft in the direction of arrow 14a, which is transmitted along the torque receiving shaft and through gear 21b to the other side of the motor. However because of the direction of winding of spring 17b, this movable spring clutch and its associated gear 19b are permitted to slip around shaft 7b which, for this particular cycle, is fixed in postion. When the next cycle begins, shaft 13 will again be rotated in the direction of arrow 14a, but through rotation of rotor 3a rather than rotor 3b as described immediately above. At the same time, the drive produced on torque receiving shaft 13 is transmitted back to gear 19a which, through the provision of movable spring clutch 17a, is permitted to slip relative to shaft 7a which is now fixed in position. It should be noted that the direction of rotation of torque receiving shaft 13 is consistent regardless of which rotor is in operation.

All the spring clutches are manufactured such that they are slightly smaller at their inside diameters than the outer diameters of the rotor shafts on which they are mounted. Each of the springs has a smooth inner surface providing good contact with its rotor shaft to provide for a good binding action against rotation in the one direction while allowing the rotor shaft to turn almost freely in the appropriate direction.

Figure 4:
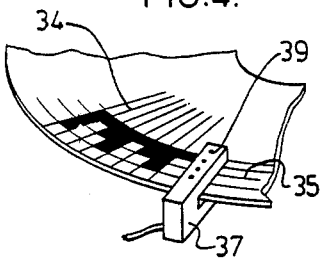
FIG. 4 is a partial section of a pickup device used in determining the positions of the rotors of the motor of FIG. 1.

In the event that there may be undesired movement of the rotors at inappropriate times, a rotor position sensing device generally indicated at 31, as shown in FIG. 4, is provided at each side of the motor. Each of the rotation sensing devices comprises a disc 33 journalled on shaft portions 9a and 9b for rotation with these shaft portions. Each of the discs is provided with degree indicators 34 which can be marked, for instance, 1 through 360 degrees around the disc. The disc is further provided with zone indicators 35 running about the periphery of the disc. A photoelectric pickup device 37 is also provided at the periphery of the disc, such that the lines designating zones 35 are fed through the pickup device during rotation of the disc. Each of the pickup devices is provided with a plurality of diodes 39 positioned over the zones 35 of discs 33. These zones, as shown in FIG. 4, are marked with clear and opaque regions and sensing device 37 is able to determine the exact position of disc 33 according to the combination of opaque and clear areas that are read by diodes 39. In the examples shown in the Figures, the three outside signals on the disc alternate in a 1, 2, 3 pattern; that is fed through the sensor to a microprocessor which determines whether or not the rotors are in proper positions for producing maximum efficiency from the engine. The disc is also provided with reference positions (not shown) for indicating positions of the disc to the pickup device. The microprocessor is able to determine if the rotors have reversed slightly or if they have overrotated and, if so, at what speed they are doing so. This information is taken into account to determine when to ignite the spark plug, how much fuel to inject into the intake port and when to apply a magnetic field to an alternator which is attached to the torque receiving shaft, if positional adjustments of the rotors are required which can be made through shaft 13, since it is geared to both of the rotor shafts.

Although various preferred embodiments of the invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A rotary motor comprising a housing, first and second coaxial opposing rotors rotatable within said housing, first and second rotor shafts on which said first and second rotors are mounted respectively, a closed annular rotor chamber which is divided into power, exhaust, intake and compression regions by said rotors, ignition means for fuel combustion in the power region of said annular chamber for rotor rotation, a torque receiving shaft alternately driven by said first and second rotor shafts, a first anti-reversing spring clutch wound on said first rotor shaft and arranged to bind on said first rotor shaft for substantially preventing rotation in a first direction while allowing rotation of said first rotor shaft in a second direction opposite to said first direction, a first movable spring clutch wound around and adapted to bind on and rotate with said first rotor shaft when rotating in said second direction, a second anti-reversing spring clutch wound on said second rotor shaft and arranged to bind on said second rotor shaft for substantially preventing rotation in said first direction while allowing rotation of said second rotor shaft in said second direction, a second movable spring clutch wound around and adapted to bind on and rotate with said second rotor shaft when rotating in said second direction and drive means connecting said first and second movable spring clutches to said torque receiving shaft; said first and second rotors being adapted to alternately rotate in said second direction with said movable spring clutches providing, in turn, drive through each rotor shaft when rotating to said torque receiving shaft and providing slippage around each rotor shaft when each rotor shaft is prevented from rotating thereby enabling alternating rotation of said rotors.

2. A rotary motor as claimed in claim 1, wherein said anti-reversing spring clutches are fixed to said housing and said movable spring clutches are located outwardly along said rotor shafts from said anti-reversing spring clutches.

3. A rotary motor as claimed in claim 1, wherein said movable spring clutches are geared to said torque receiving shaft.

4. A rotary motor as claimed in claim 1, wherein each of said rotors includes a bifurcated rotor portion and wherein said housing is provided with an annular chamber for receiving the bifurcated rotor portions of said rotors.

5. A rotary motor as claimed in claim 1, wherein all of said spring clutches are of slightly smaller diameter than their respective rotor shafts to provide good binding action thereon.

6. A rotary motor as claimed in claim 1, when computer operated for controlling the timing of said motor.

7. A rotary motor as claimed in claim 4, including sensing means to said computer for sensing position of said rotors.

8. A rotary motor as claimed in claim 7, wherein said sensing means comprises two indicator wheels, one for each rotor, said wheels rotating in conjunction with said rotors and bearing position marks for indicating different positions of said rotors, and a fixed pickup member at each indicator wheel for pickup of the position marks on each wheel for determining the position thereof.

9. A rotary motor as claimed in claim 8, wherein said position marks on said indicator wheels comprise transparent and opaque areas thereon, said pickup members comprising a system of light sensing diodes and photoelectric cells for sensing said transparent and opaque areas on said indicator wheels.

* * * * *